United States Patent [19]

Nagasaka et al.

[11] Patent Number: 4,743,940

[45] Date of Patent: May 10, 1988

[54] THERMAL FIXING ROLLER FOR USE IN A COPYING MACHINE AND METHOD FOR MANUFACTURING THE SAME

[75] Inventors: Hideo Nagasaka, Hitachi; Tsutomu Itoh, Tokyo; Manabu Shimoizumi, Ichikawa; Hiroshi Saitoh, Funabashi; Kenzo Yanagida, Ichikawa; Kazunori Fujita, Funabashi; Masayuki Kitoh, Higashikurume, all of Japan

[73] Assignee: Onoda Cement Company, Ltd., Ibaraki, Japan

[21] Appl. No.: 96,735

[22] Filed: Sep. 15, 1987

[30] Foreign Application Priority Data

Sep. 22, 1986 [JP] Japan ..... 61-224333
Dec. 29, 1986 [JP] Japan ..... 61-310092
Dec. 29, 1986 [JP] Japan ..... 61-310093

[51] Int. Cl.[4] ..... G03G 15/00

[52] U.S. Cl. ..... 355/3 FU; 355/14 FU; 219/216; 428/36; 29/611

[58] Field of Search ..... 355/3 FU, 14 FU; 219/216; 428/36; 29/611, 618, 620

[56] References Cited

U.S. PATENT DOCUMENTS 4,395,109 7/1983 Nakajima et al. ..... 355/3 FU
4,438,321 3/1984 Moran ..... 219/216
4,540,267 9/1985 Moser ..... 355/14 FU X
4,611,902 9/1986 Schön ..... 355/3 FU
4,628,183 12/1986 Satomura ..... 219/216

*Primary Examiner*—A. C. Prescott
*Attorney, Agent, or Firm*—Price, Heneveld, Cooper, Dewitt & Litton

[57] ABSTRACT

A thermal fixing roller for use in a copying machine and a method for manufacturing the thermal fixing roller are disclosed. An insulator layer is formed on an outer surface of a cylindrical metallic pipe, a masking wire material is wound in a spiral manner on the surface of the insulator layer and a heat-generating resistor is formed by spray coating heat-generating resistor material on the insulator and wire surfaces. Thereafter the wire material is removed to leave a groove at its trace, and thereby the above-mentioned heat-generating resistor can be formed in a spiral shape. By choosing pitches at the opposite end portions of this spiral resistor smaller than that at the central portion thereof, uniform temperature is maintained over the entire length of the thermal fixing roller. Also by forming a cross-section configuration of the masking wire material in a rectangular shape, it is allowed to reduce the width of the above-mentioned groove to minimum.

26 Claims, 4 Drawing Sheets

THERMAL FIXING ROLLER FOR USE IN A COPYING MACHINE AND METHOD FOR MANUFACTURING THE SAME

BACKGROUND OF THE INVENTION

The present invention relates to a thermal fixing roller for use in an electronic copying machine, and more particularly, to a thermal fixing roller for thermally fixing a dry type developing agent consisting principally of colored toner and resin on a support in an electronic copying machine.

In a heretofore known thermal fixing roller, a heater is provided on the inside of a metallic support of cylindrical shape, and the surface of the thermal fixing roller is heated by this heater.

However, since this heating process relies upon thermal radiation from the heater, a heat-up time, that is, a time period necessitated from start of the copying machine until the copying machine becomes available is long, and it takes about 1 to 2 minutes.

Hence, a thermal fixing roller of the so-called planar heat-generating resistor type, is employed, in which a planar heat-generating resistor is provided on a surface of a support for the purpose of shortening the above-mentioned heat-up time, an electric current is passed from one end of the resistor towards the other end, and the roller surface is directly heated by Joule's heat generated at this time.

However, as the thickness of this planar heater is uniform over its entire length and the opposite end portions of the heater is liable to be cooled as compared to its central portion, surface temperature distribution in the axial direction of the thermal fixing roller is such that the temperature at the opposite end portions of the roller is lower than that at the central portion. Consequently, it becomes difficult to attain a uniform picture.

Therefore, in the prior art, a thermal fixing roller in which equalization of the above-mentioned temperature distribution was attempted by forming a film of a resistor on a thermal fixing roller in a fixed thickness, scraping this film of a resistor in the proximities of the opposite ends of the roller, and increasing resistances of these portions, was known (See Japanese Laid-Open Patent Specification No. 59-154476(1984)). However, in this example of the prior art, a troublesome work of scraping a film of a resistor in the proximities of the opposite ends of the roller is necessitated and a lot of time and labor is necessary therefor, which causes rise of cost of a roller.

In addition, since the thickness of the resistor film is thin, for example, 50 μm, it is extremely difficult to scrape this film up to a desired thickness, and therefore, temperature distribution on a roller surface is liable to become uneven.

SUMMARY OF THE INVENTION

In view of the above-mentioned circumstance, the present invention has it as an object to make surface temperature distribution on a thermal fixing roller uniform.

Another object of the present invention is to provide a thermal fixing roller that is low in cost.

According to the present invention, a belt-like heat-generating resistor is formed in a spiral manner on a surface of a cylindrical insulative support, the pitch of the heat-generating resistor is decreased gradually from the central portion of the roller towards the opposite end portions, a current is passed through the belt-like heat-generating resistor to heat the register by Joule's heat of the current, a resistance is made larger at the opposite end portions of the roller than its central portion by varying the pitch of the heat-generating resistor in the above-described manner, thereby a heat-generating rate at the opposite end portions is made larger than that at the central portion to make the heat-generating rate balance with the heat-dissipating rate from the opposite end portions, and the temperature distribution on the roller surface is made to be uniform over its entire length.

Also, the present invention resides in a thermal fixing roller for use in a copying machine of the type that a belt-like heat-generating resistor layer and a groove or grooves are formed in a spiral manner on a surface of a cylindrical insulative support, and an anti-adhesion layer is provided on the surfaces of these, in which a cross-section configuration of the groove taken along a plane containing the axis of the support is formed in a rectangular shape.

Furthermore, the present invention exists in a method for manufacturing a thermal fixing roller for use in a copying machine, consisting of the steps of winding a masking wire material having a rectangular cross-section in a spiral manner around a surface of a cylindrical insulative support, forming a heat-generating resistor layer on the surface of the wound assembly, thereafter removing the wire material to form a groove at its trace, and then forming an anti-adhesion layer on the surface of the grooved assembly.

DESCRIPTION OF THE PREFERRED EMBODIMENTS

Figure 1:
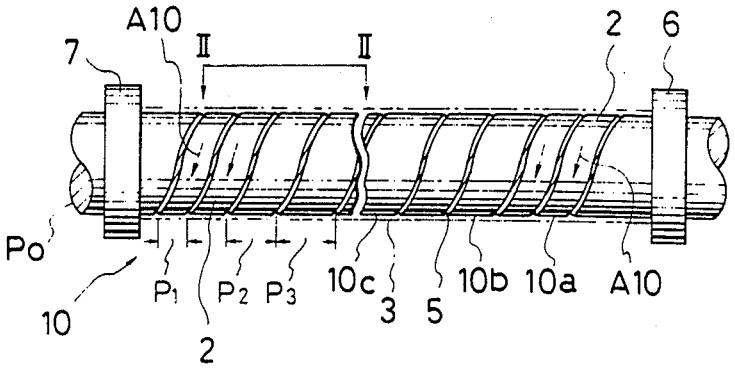
FIG. 1 is a plan view showing one preferred embodiment of the present invention.
Figure 2:
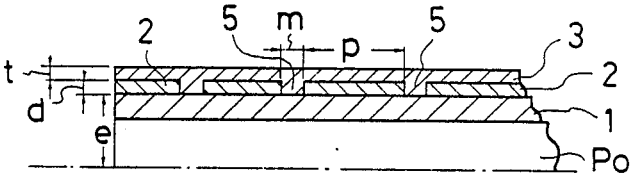
FIG. 2 is an enlarged partial cross-section view of the portion indicated by arrowed line II—II in FIG. 1.

In FIG. 1, reference character $P_0$ designates a metallic hollow pipe. On the surface of this pipe $P_0$ is formed an insulator layer 1 as shown in FIG. 2, and further, on the surface of the insulator layer 1 is formed a heat-generating resistor 2.

This insulator layer is a thin film formed by plasma spray-coating alumina ($Al_2O_3$), spinel ($Al_2O_3$,MgO) or the like, and its thickness is, for example, 200 μm.

Figure 3:
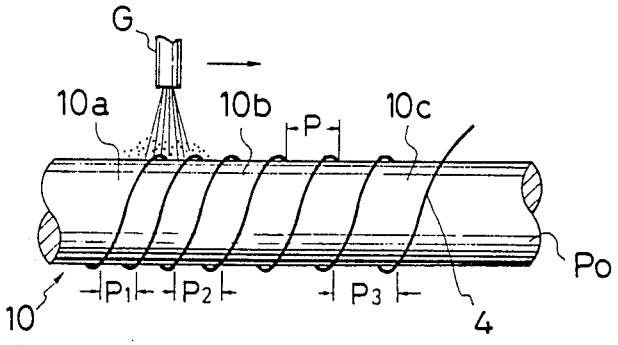
FIG. 3 is a schematic front view showing a process of forming a heat-generating resistor.

The heat-generating resistor 2 is formed in the following manner. At first, a masking wire material, for example, a metal wire 4 is wound in a spiral manner around the surface of the insulator layer 1 as shown in FIG. 3.

As this metal wire 4, it is preferable to use, for instance, an Invar wire of 0.6 mm in diameter for the purpose of preventing thermal expansion of the masking wire material upon thermal spray coating, but a copper wire could be used under a high tension.

A pitch P of the metal wire 4 is successively narrowed in the order of a central portion 10*c*, a side portion 10*b* and an end portion 10*a* of the thermal fixing roller 10, and for instance, a pitch $P_1$ of the end portion 10*a* is 4 mm, a pitch $P_2$ of the side portion 10*b* is 5 mm and a pitch $P_3$ of the central portion 10*c* is 6 mm.

After the metal wire 4 has been wound in the above-described manner, resistor material such as, for instance, nichrome, stainless steel, nickel, aluminium or aluminium solder is thermally spray-coated on the roller by means of a thermal spray-coating gun G, and thereby the heat-generating resister 2 is formed.

The above-mentioned aluminum or aluminium solder is most suitable as resistor material because it does not change in resistance at a high temperature and moreover it is cheap. This resistor 2 is like a thin film, and its thickness d is, for instance, 40 μm.

In this instance, by plasma spray coating or arc spray coating aluminium with air (Japanese Patent Application No. 60-181081 (1985) or 60-181082 (1985)), a stable heat-generating resistor can be formed. It is to be noted that instead of employing the above-described thermal spray coating, vapor deposition, spattering, ion-plating, etc. could be employed. Thereafter, when the metal wire 4 is removed from the surface of the roller 10, a spiral groove 5 is formed at its trace, hence the heat-generating resistor 2 takes a spiral form as shown in FIG. 1, and the pitch of this heat-generating resistor 2, that is, the pitch P of the metal wire 4 decreases successively from the central portion 10*c* of the roller, via the side portion 10*b* towards the end portion 10*a*.

Subsequently, an anti-adhesion film 3 is formed on the surface of the roller, and this film 3 is formed up to a thickness t of for example 50 μm fluorine resin or silicone resin coating.

After finishment of this coating, the surface of the anti-adhesion film 3 is smoothened by grinding, also an electric power feeding section 6 is provided at one end of the hollow pipe $P_0$, another electric power feeding section 7 is provided at the other end, and these electric power feeding sections 6 and 7 are respectively connected to the opposite ends of the heat-generating resistor 2.

If an electric current is made to flow through the heat-generating resistor 2 from the electric power feeding section 6, this current flows in the direction of arrow A10 while heating the resistor 2 by Joule's heat and reaches the electric power feeding section 7.

In this way, the roller surface temperature rises due to Joule's heat, and since the pitch P of the heat-generating resistor 2 is successively narrowed in the order of the central portion 10*c*, the side portion 10*b* and the end portion 10*a* of the thermal fixing roller 10, in other words, the pitches $P_1$ and $P_2$ of the portions where a highest heat-generating rate and a higher heat generating rate are respectively necessitated, are smaller than the pitch $P_3$ of the other portion, the roller surface temperature becomes uniform over its entire length.

In more particular, if a resistance is denoted by R, a specific resistance of material by $\rho$, a length of a resistor by L, and a cross-section area of the resistor by S, then the resistance R is represented by a formula of $R=\rho \cdot L/S$.

Now, indicating a pitch of the heat-generating resistor by P, its thickness by d, and a radius of the insulator layer 1 by e, then a resistance r per unit distance in the direction of the roller axis of the resistor is represented by a formula of $r=\rho \cdot 2\pi e(1/P)(d \cdot P)$.

Assuming that reference character C denotes a constant, the resistance r is represented by a formula of $r=C/P^2$, that is, the resistance r per unit distance in the direction of the roller axis of the resistor is inversely proportional to square of the pitch P of the heat-generating resistor.

Accordingly, if the pitch P of the resistor 2 is chosen such that a pitch $P_1$ at an end portion 10*a* of the roller 10 is 4 mm, a pitch $P_2$ at a side portion 10*b* is 5 mm and a pitch $P_3$ at a central portion 10*c* is 6 mm, then because of the above-mentioned relation, the proportions of the resistances r becomes such that representing the proportion of the resistance at the end portion 10*a* is taken to be 1, that at the side portion 10*b* becomes 0.64 and that at the central portion 10*c* becomes 0.44.

Representing a current value by i, then a heat generating rate W per unit distance is indicated by a formula of $W=i^2r$ according to the Joule's Law, that is, it is proportional to the resistance r, hence the heat generating rate W is increased successively from the central portion 10*c* towards the end portion 10*a*, so that thermal dissipation from the opposite end portions 10*a* and from the both side portions 10*b* can be balanced by the increased heat-generating rate, and after all, the surface temperature distribution in the direction of the roller axis would become uniform.

Figure 8:
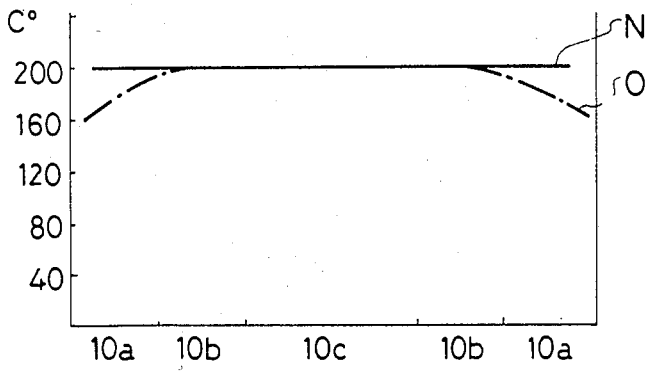
FIG. 8 is a diagram showing temperature distribution on a roller surface.

When the roller surface temperature distributions for the illustrated embodiment and for the heretofore known rollers were experimentally compared with each other, the results indicated in FIG. 8 were obtained. More particularly, in the case of the heretofore known roller, the results are reresented by curve "0", in which a temperature difference of about 30° C. in average exists between the roller end portion 10*a* and the central portion 10*c*, where as in the case of the illustrated embodiment, the results are represented by curve "N", in which the entire roller surface 10*a*–10*c* is held uniformly at 200° C.

It is to be noted that although the current (power) feed to the heat-generating resistor 2 is effected continuously during a heat-up time, thereafter even if it is effected intermittently, a necessary roller surface temperature can be maintained. In the case where the resistance of the heat generating resistor 2 is chosen to be 10Ω and a voltage of 100 V is applied thereto in the above-described embodiment, consumed electric power is 1 KW, a heat-up time up to 200° C. is 10 seconds, and thus the heat-up time can be greatly shortened as compared to the heretofore known roller.

As a method for forming a belt-like heat-generating resistor in a spiral manner, it may be conceived to form a resistor film by coating resistor material over the entire surface of the insulator layer of the roller and then cutting a groove in this resistor film in a spiral manner, but in this method, in order to perfectly separate adjacent resistor portions from each other, it is necessary to cut the groove somewhat deeply, that is, to an extent that the groove may dig in the insulator layer.

Consequently, when an anti-adhesion film is formed by coating fluorine resin on the resistor film, unevenness would arise on the surface and thus flatness is liable to be lost.

Therefore, after an anti-adhesion film has been once formed thick, it is compelled to grind the surface of the anti-adhesion film to make it smooth, but this grinding work necessitates a lot of time, and moreover, would scrape away the expansive material for the anti-adhesion film, so that this causes rise of cost of the thermal fixing roller.

Whereas, if the heat-generating resistor is formed through the above-mentioned process, grooves 5 between adjacent portions of the resistor 2 become shallow because the thickness d of the resistor 2 can be made thin.

Accordingly, when the anti-adhesion film 3 is formed by coating fluorine resin on the resistor 2, the surface of the film 3 would naturally take a flat condition, and so, the above-mentioned problems relating to the grinding work would not occur.

According experiments, if a width m of the groove 5 is made to be 500 μm or less, for instance, to be 400 μm, an anti-adhesion film 3 having a film thickness t=50 μm or less is formed by coating fluorine resin thereon and the film 3 is subjected to grinding to obtain surface smoothness that is necessary for preventing adhesion, then the surface would become a smooth surface to such extent that no inconvenience may arise in use.

The present invention is not limited to the above-described preferred embodiment, but, for instance, the belt-like heat-generating resistor could be formed in a double spiral shape.

Figure 4:
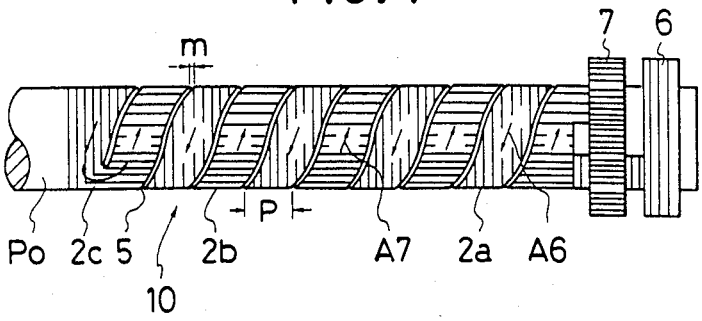
FIG. 4 is a plan view showing another preferred embodiment of the present invention.

This modified embodiment will be explained with reference to FIGS. 4 to 6, in which items designated by the same reference numerals as those used in FIGS. 1 to 3 have the same names and functions as the corresponding items in FIGS. 1 to 3.

Figure 5:
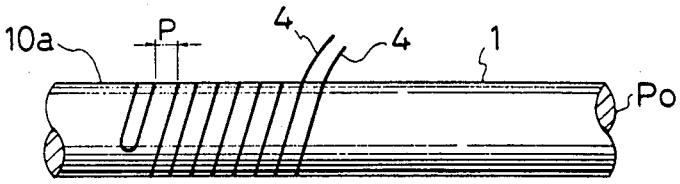
FIG. 5 is a schematic plan view showing a method of windng a metal wire around a support for the embodiment shown in FIG. 4.

As shown in FIG. 5, a metal wire 4 is wound in a double spiral shape around a surface of an insulator layer 1, aluminium solder or the like is spray coated thereon a form a heat-generating resistor 2, and thereafter when the metal wire 4 is removed, grooves 5 of a double spiral shape would remain at the trace of the metal wire 4. As shown in FIG. 6, pitches $P_3$, $P_2$ and $P_1$ of the grooves 5 decrease successively from a central portion 10*c* of the roller towards its end portions 10*a*. This resistor 2 consists of a foward path resistor 2*a* and a backward path 2*b* as shown in FIG. 4, and one ends of these resistors 2*a* and 2*b* are electrically connected at a connecting portion 2*c*.

Subsequently, an anti-adhesion film 3 is formed on the roller surface, and also in order to achieve simplification of wirings within a copying machine, electric power feeding sections 6 and 7 are provided at one end of a hollow pipe $P_0$. Then the forward path resistor 2*a* is connected to the electric power feeding section 6, and the backward path resistor 2*b* is connected to the electric power feeding section 7.

If an electric current is made to flow from the electric power feeding section 6 through the forward path resistor 2*a*, then this current flows in the direction of arrow A6 while heating the resistor 2*a* by Joule's heat and generating a magnetic field therearound, and reaches the connecting portion 2*c*.

Then, the current which has reached the connecting portion 2*c* is diverted at this point to flow through the backward path resistor 2*b*, and similarly to the above-mentioned process, it flows in the direction of arrow A7 while generating Joule's heat and a magnetic field and reaches the electric power feeding section 7.

At this time, since the forward path resistor 2*a* and the backward path resistor 2*b* are formed in a double spiral shape, the currents flowing through these resistors 2*a* and 2*b*, respectively, are directed in the opposite directions to each other.

Consequently, the magnetic field generated around the resistor 2*a* and the magnetic field generated around the resistor 2*b* would offset each other, and after all, the magnetic field around the resistors 2*a* and 2*b*, that is, around the heat-generating resistor 2 would almost disappear. By way of example, when the magnetic field strength at the location at a distance of 2 cm from the hollow pipe $P_0$, the insulator layer 1 and the heat-generating resistor 2, respectively, was measured, in the case of a belt-like heat-generating resistor of single spiral shape, the highest measured value was 9.3 Gauss and the next high value was 7.2 Gauss, whereas in the case of a belt-like heat-generating resistor of double spiral shape, the highest measured value was 0.4 Gauss and the next high value was 0.2 Gauss, and thus it was proved that if the resistor 2 is formed in a double spiral shape, a magnetic field strength would be decreased remarkably.

Figure 6:
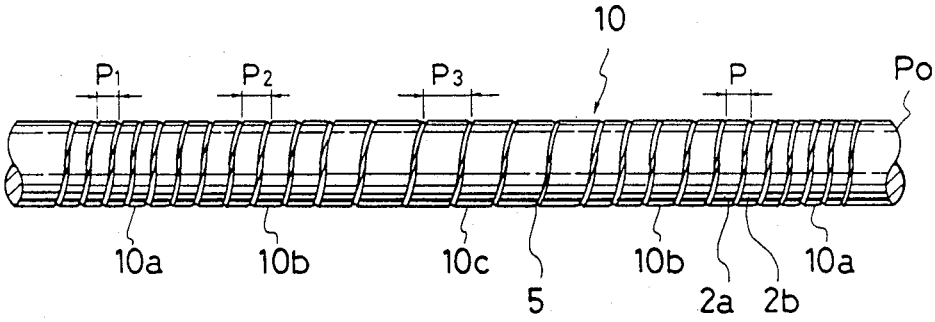
FIG. 6 is a plan view showing the state where a metal wire has been removed after a heat-generating resistor was formed.

In this modified embodiment also, since the pitches P of the heat-generating resistors 2*a* and 2*b* are successively reduced in the order of the central portion 10*c*, the side portions 10*b* and the end portions 10*a* of the thermal fixing roller 10 as shown in FIG. 6, it is a matter of course that the surface temperature of the roller becomes uniform over its entire length similarly to the above-described first preferred embodiment.

Figure 7:
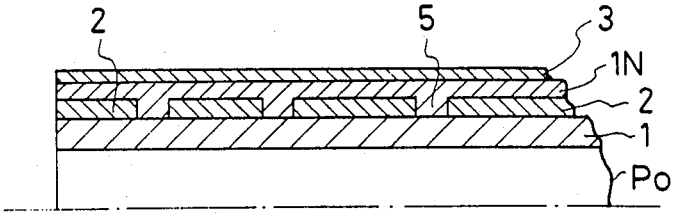
Fig. 7 is an enlarged partial cross-section view corresponding to FIG. 2 in a further preferred embodiment of the present invention.

While the belt-like heat-generating resistor 2 is directly covered by an anti-adhesion film in the embodiment shown in FIG. 2, modification could be made thereto such that an insulator film 1N is formed on the surface of the belt-like heat-generating resistor 2 and an anti-adhesion film 3 is formed thereon as shown in FIG. 7.

If the insulator film 1N is formed between the heat-generating resistor 2 and the anti-adhesion film in the above-described manner, then the anti-adhesion film 3 becomes tough, also its surface becomes flat, and electrical safety is improved.

According to the present invention, as the belt-like heat-generating resistor is formed in a spiral shape, if the pitch of the heat-generating resistor is gradually decreased from the central portion of the roller towards the opposite end portions, then the resistance at the opposite end portions becomes larger than the resistance at the central portion.

Accordingly, a heat generating rate would be increased from the central portion of the roller towards the end portions, hence it can be balanced with heat dissipation from the opposite end portions, after all the surface temperature distribution in the axial direction of the roller becomes as represented by a straight line N in FIG. 8, and the entire roller surface is helt at a uniform temperature.

In addition, when the resistance of the heat-generating resistor is gradually decreased from the central portion of the roller towards the opposite end portions, it is only necessary to simply decrease the pitch of the spiral heat-generating resistor gradually, and therefore a manufacturing cost of the roller becomes cheap as compared to the thermal fixing rollers in the prior art.

Furthermore, if the belt-like heat-generating resistor is formed in a double spiral shape, one ends of the spirals are electrically connected to each other and the other ends of the spirals are respectively connected to separate electric power feeding sections, then when an electric current is fed from the electric power feeding section through the heat-generating resistor, the electric current reciprocates on the roller surface while flowing in a spiral manner. At this time, the magnetic fields generated in association with the forwards and backwards electric currents would off set each other and disappear, and so, a magnetic field is almost not present on the surface of the thermal fixing roller.

Figure 9:
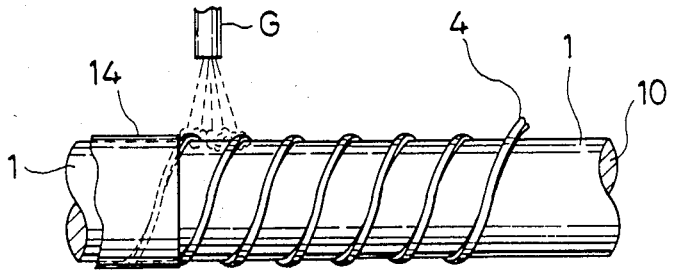
FIG. 9 is a plan view showing a process of forming a heat-generating resistor in still another preferred embodiment of the present invention.
Figure 10:
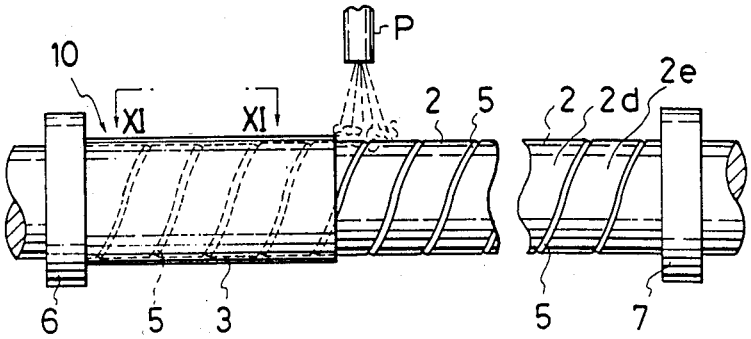
Fig. 10 is a plan view showing a process of forming an anti-adhesion layer.
Figure 11:
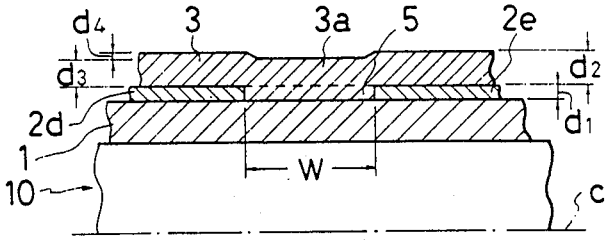
FIG. 11 is an enlarged partial cross-section view of the portion indicated by arrowed line XI—XI in FIG. 10.

Referring now to FIG. 9, reference numeral 10 designates an insulative support prepared by forming an insulator layer 1 on a surface of a metallic hollow pipe $P_0$. This insulator layer 1 is a thin film formed by plasma spray coating alumina or magnesia alumina spinel, and its thickness is, for example, 200 μm.

On the surface of this insulator layer 1 is spirally wound a masking wire material having a rectangular cross-section, for instance, a metal wire 4 having, a cross-section of 0.1 mm in thickness by 0.3 mm in width, so as to come into surface contact with each other. For this masking wire material, an Invar wire or a copper wire having a rectangular cross-section could be employed.

Subsequently, heat-generating resistor material such as, for instance, nichrome, stainless steel, aluminium, aluminium solder, etc. is thermally spray-coated by making use of a thermal spray-coating gun on the insulator layer 1 having the metal wire 4 wound therearound and thereby the heat-generating resistor layer 2 is formed. These aluminium and aluminium solder have extremely small change in resistance at a high temperature and also are cheap, so that these materials are most suitable for the resistor material.

After the heat-generating resistor layer 2 has reached a predetermined thickness $d_1$, for example, $d_1=30$ μm through this thermal spray coating process, when the metal wire 4 is removed from the resistor layer 2, on the surface of the insulator layer 1 are formed a belt-like heat-generating resistor 2 and a groove 5 alternately in a spiral shape.

At this time, a cross-section configuration of the groove 5 taken along a plane containing an axis C of the insulative support 10 is a rectangular shape of 30 μm in thickness by 0.3 mm in width, and the respective portions **2*d* and 2*e* of the heat-generating resistor 2 are perfectly separated by this groove 5**.

Subsequently, the heat-generating resistor portions **2*d* and 2*e* and the groove 5 are subjected to spray coating of fluorine resin or silicone resin by means of a powder painting gun P, and thereby an anti-adhesion layer 3** is formed.

At this point in the process, a thickness $d_2$ of the anti-adhesion layer 3 is, for example, 100 μm, and a thickness $d_3$ of the anti-adhesion layer 3 above the groove 5 is, for example, 90 μm.

A thickness difference $d_4$ between the thickness $d_2$ and the thickness $d_3$ is only 10 μm, which is extremely reduced as compared to the case of using the masking wire material whose sectional configuration is circular. This owes to the fact that the groove width W has been reduced to about one-half of that in the case mentioned above.

After finishment of coating, the surface of the anti-adhesion layer 3 is ground to smoothen the surface of the roller 10, and electric power feeding sections 6 and 7 are disposed at the end portions of the thermal fixing roller 10.

The anti-adhesion layer as used according to the present invention could be composed of a lower layer consisting of a mechanically strong insulator layer, for instance a ceramic layer and an upper layer consisting of a Teflon ® layer. If such provision is made, the mechanically weak Teflon ® layer can be protected by the lower insulator layer, and also, the Teflon ® layer can be formed thin. In addition, even if the Teflon ® layer is made thin, the surface of the anti-adhesion layer can be easily flattened because the insulator layer lies thereunder.

Figure 12:
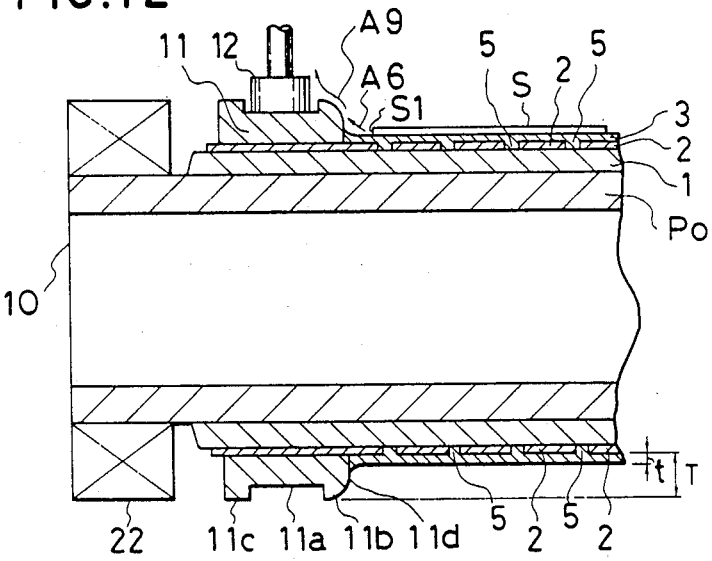
FIG. 12 is an enlarged longitudinal cross-section view of a part of yet another preferred embodiment of the present invention.

Still another preferred embodiment of the present invention will be explained with reference to FIG. 12. An insulator layer 1 is formed on a surface of a metallic hollow pipe $P_0$ supported by a bearing 22. A belt-like heat-generating resistor 2 and a groove 5 are formed alternately in a spiral shape on the surface of the insulator layer 1, and on the surface of this heat-generating resistor 2 is formed an anti-adhesion layer 3 by coating fluorine resin or silicone resin.

A slip ring 11 is formed in a true round shape by machining, and in a central portion of its outer circumference is formed a recess **11*a* adapted to come into contact with a collector 12. A thickness T of the opposite end portions 11*b* and 11*c* of the slip ring 11 is made thicker than a thickness t of the anti-adhesion layer 3, and an end surface 11*d* of the end portion 11*b* continues to the surface of the anti-adhesion layer 3** via a smoothly curved surface.

When an electric power is fed from the collector 12 to the slip ring 11, the heat-generating resistor 2 is heated, and thermal fixing is effected for a sheet S on the thermal fixing roller 10.

At this time, if the roller 10 is rotated with the sheet S not properly set, then the sheet S would shift towards the slip ring 11 as indicated by arrow A8 and its edge portion S1 would strike against the end surface **11*d*. Then, owing to the smoothly curved surface 11*d*, the shifting edge portion S1 would rise in the direction of arrow A9 as guided by the curved end surface 11*d***.

Accordingly, paper-sheets S would never enter between the slip ring 11 and the collector 12, and hence occurrence of fire can be prevented. In addition, since the slip ring is statically fitted, if the slip ring is preliminarily formed in a true round shape by machining, a slip ring having an excellent roundness can be obtained. Moreover, if the slip ring is statically fitted after formation of the anti-adhesion film, the slip ring is not subjected to heating upon formation of the anti-adhesion film, and hence it would not be oxidized. Accordingly, a resistance at this portion would not be increased, and therefore, stable power feeding can be achieved.

What is claimed is:

1. A thermal fixing roller for use in a copying machine characterized in that a belt-like heat-generating resistor is formed in a spiral shape on a surface of a cylindrical insulative support.

2. A thermal fixing roller for use in a copying machine as claimed in claim 1, characterized in that said insulative support has an insulator layer formed on its surface.

3. A thermal fixing roller for use in a copying machine as claimed in claim 2, characterized in that said insulator layer takes a thin film shape.

4. A thermal fixing roller for use in a copying machine as claimed in claim 2, characterized in that said insulator layer is formed by plasma spray coating of alumina or spinel.

5. A thermal fixing roller for use in a copying machine as claimed in claim 1, characterized in that said belt-like heat-generating resistor has its portion necessitating a higher heat generating rate formed narrower in width than the other portion.

6. A thermal fixing roller for use in a copying machine as claimed in claim 1, characterized in that said belt-like heat-generating resistor is formed in a double spiral shape, one ends of the spirals electrically connected to each other, and the other ends are respectively connected to separate electric power feeding sections.

7. A thermal fixing roller for use in a copying machine as claimed in claim 1, characterized in that said belt-like heat-generating resistor takes a thin film shape.

8. A thermal fixing roller for use in a copying machine as claimed in claim 1, characterized in that said belt-like heat-generating resistor is formed by thermal spray coating of resistor material.

9. A thermal fixing roller for use in a copying machine as claimed in claim 1, characterized in that said belt-like heat-generating resistor is formed by plasma spray coating or arc spray coating of resistor material.

10. A thermal fixing roller for use in a copying machine as claimed in claim 1, characterized in that said belt-like heat-generating resistor is formed by thermal spray coating resistor material with air.

11. A thermal fixing roller for use in a copying machine as claimed in claim 1, characterized in that said belt-like heat-generating resistor is formed by winding a masking wire material in a spiral manner around an outer circumference of an insulative support, then thermal spray coating resistor material thereon, and thereafter removing said wire material.

12. A thermal fixing roller for use in a copying machine as claimed in claim 11, characterized in that said masking wire material in an Invar wire or a copper wire.

13. A thermal fixing roller for use in a copying machine as claimed in claim 8, characterized in that said resistor material is aluminium or aluminium solder.

14. A thermal fixing roller for use in a copying machine as claimed in claim 1, characterized in that said belt-like heat-generating resistor is covered by an insulator film.

15. A thermal fixing roller for use in a copying machine as claimed in claim 14, characterized in that said insulator film is covered by an anti-adhesion film.

16. A thermal fixing roller for use in a copying machine as claimed in claim 1, characterized in that said belt-like heat-generating resistor is covered by an anti-adhesion film.

17. A thermal fixing roller for use in a copying machine as claimed in claim 16, characterized in that said anti-adhesion film is formed by coating of fluorine resin or silicone resin.

18. A thermal fixing roller for use in a copying machine as claimed in claim 16, characterized in that said anti-adhesion film fills heat-generating resistor grooves of 500 μm or less in width and a film thickness thereof is 50 μm or less.

19. A thermal fixing roller for use in a copying machine in which a belt-like heat-generating resistor and a groove are formed in a spiral shape on a surface of a cylindrical insulator layer and an anti-adhesion layer is provided on the surface of these, characterized in that a cross-section configuration of said groove taken along a plane containing an axis of said insulator layer is formed in a rectangular shape.

20. A thermal fixing roller for use in a copying machine as claimed in claim 19, characterized in that said anti-adhesion layer is composed of a lower layer consisting of an insulator layer and an upper layer consisting of a Teflon® layer.

21. A thermal fixing roller for use in a copying machine in which a heat-generating resistor is formed on a surface of a cylindrical insulator layer, a slip ring is formed at end portions of said resistor and an anti-adhesion layer is formed on the remainder portion thereof, characterized in that said slip ring includes an end portion thicker than said anti-adhesion layer and it is statically fitted.

22. A thermal fixing roller for use in a copying machine as claimed in claim 21, characterized in that said heat-generating resistor has a belt-like configuration.

23. A thermal fixing roller for use in a copying machine as claimed in claim 21, characterized in that said slip ring has a recess formed at a central portion of its outer circumferential surface.

24. A method for manufacturing a thermal fixing roller for use in a copying machine including the steps of winding a masking wire material in a spiral manner on a surface of a cylindrical insulator layer, then forming a heat-generating resistor on the surface of these, thereafter removing said wire material to form a groove, and forming an anti-adhesion layer on the surface of these, characterized in that said masking wire material has a rectangular cross-section shape.

25. A thermal fixing roller for use in a copying machine as claimed in claim 9, characterized in that said resistor material is aluminium or aluminium solder.

26. A thermal fixing roller for use in a copying machine as claimed in claim 10, characterized in that said resistor material is aluminium or aluminium solder.

* * * * *